US007712179B2

(12) United States Patent
Lemke

(10) Patent No.: US 7,712,179 B2
(45) Date of Patent: May 11, 2010

(54) CONVENIENT TICKET SCRAPER

(76) Inventor: Patrick Timothy Lemke, 57 E. 23rd St., Huntington Station, NY (US) 11746

( * ) Notice: Subject to any disclaimer, the term of this patent is extended or adjusted under 35 U.S.C. 154(b) by 0 days.

(21) Appl. No.: 11/801,435

(22) Filed: May 10, 2007

(65) Prior Publication Data

US 2008/0163441 A1 Jul. 10, 2008

Related U.S. Application Data

(60) Provisional application No. 60/879,073, filed on Jan. 8, 2007.

(51) Int. Cl.
*A47L 13/02* (2006.01)
*B26B 3/00* (2006.01)

(52) U.S. Cl. ..... 15/236.01; 15/105; 30/169; 362/119

(58) Field of Classification Search ..... 15/236.01, 15/236.07, 105; 30/169; D32/46, 42, 43; 362/119
See application file for complete search history.

(56) References Cited

U.S. PATENT DOCUMENTS

| | | | | | |
|---|---|---|---|---|---|
| D312,341 | S | * | 11/1990 | Demirjian | D32/46 |
| 5,095,573 | A | * | 3/1992 | Henke et al. | 15/105 |
| 5,653,818 | A | * | 8/1997 | Genardi | 134/6 |
| 6,041,532 | A | * | 3/2000 | Pollhaus et al. | 40/455 |
| 6,282,742 | B1 | * | 9/2001 | Boggs | 15/236.02 |
| 6,470,574 | B1 | * | 10/2002 | Strumke, Jr. | 30/169 |
| 2002/0152572 | A1 | * | 10/2002 | Steinmetz et al. | 15/236.01 |
| 2005/0229345 | A1 | * | 10/2005 | Rouse et al. | 15/105 |
| 2007/0169299 | A1 | * | 7/2007 | Stankovic | 15/236.01 |

* cited by examiner

*Primary Examiner*—Laura C Guidotti
(74) *Attorney, Agent, or Firm*—Limin Wen

(57) ABSTRACT

A convenient ticket scraper is comfortable for use in scraping various surfaces and consists of a main body with a guitar pick shape and an arcuate protruding blade. The main body has a banana shaped key ring hole in one end and the arcuate protruding blade with the thickness of a coin in the other end. There is an even beveled area covered by rubber on each side of the main body for a thumb and a forefinger. An appealing version of this scraper is also disclosed.

3 Claims, 3 Drawing Sheets

CONVENIENT TICKET SCRAPER

REFERENCE TO RELATED APPLICATION

This application claims the benefit of the filing date of U.S. Provisional Application Ser. No. 60/879,073, entitled "SCRATCH OFF PICK" and filed on Jan. 8, 2007. The teachings of the entire referenced application are incorporated herein by reference.

FIELD OF THE INVENTION

This invention relates generally to a handy, easily usable device for quickly and accurately scraping the surface layer of any scratch ticket, particularly the lottery tickets.

BACKGROUND OF THE INVENTION

Scratch tickets are very well known and are widely used by lottery organization and also for drawing all kinds of prizes. These "scratch tickets" are so called because they are covered with a layer, or layers, of opaque materials that hide text printed on the surface of the ticket that tells the buyer or player whether or not he or she has won. In these types of tickets one or more winning numbers or combinations are covered with a waxy like material. It is then merely necessary to scratch these covered portions to discover if the number or combination is a lucky one. The buyer or player in a variety of ways, including fingernails, knives, coins or the like, scratches off the surface.

In practice, a coin or a knife is used to remove the waxy like substance. This is not always practical and is certainly not convenient. On one hand, if the buyer cannot find the coin or the knife immediately, this means that the person buying it have to wait to arrive at home before scratching it. On the other hand, if a device would readily be available to scratch the covered number or combination, the distributor of the tickets would face the possibility of selling many more tickets or coupons to unlucky buyers. Moreover, gripping a coin to scratch is awkward, and may cause certain parts of the hand to become fatigued, especially since the pressure must be channeled through the limited area used to grasp the coin. If the pressure could be more evenly distributed over a larger and soft surface, and throughout the hand, this discomfort could be avoided.

A number of devices of varying effectiveness have been developed to aid in removing the surface or coating. These range from simple manual scrapers in which a scraping edge is manually brought into contact with the coating while the ticket is pulled past the edge, as typically described by Rizzo in U.S. Pat. No. 4,793,061 to large, complex electrically powered devices, using a rotating brush or the like to scrape away the coating as typically described by Forrest in U.S. Pat. No. 5,402,549. With the simple device of Rizzo, the plastic scraper blade will wear rapidly and great care must be used in scraping to remove only the coating and not damage the underlying symbols. On the other hand, the Forrest device is large and expensive, must be carefully aligned to remove only the coating, and is likely to damage the symbols if the ticket should jam in contact with the rotating brush.

Other manual scrapers are described by Fox in U.S. Pat. No. 5,419,004 and Diba et al. in U.S. Pat. No. 4,777,693. These also require careful application of just the correct amount of pressure on a scraping blade assembly to fully remove the coating while avoiding damage to the symbols.

Other motor driven scrapers are described by Clark in U.S. Pat. No. 5,253,383 and Sanders et al. in U.S. Pat. No. 4,765, 842. These also are relatively expensive, require the provision of batteries or connection to mains and require the ticket to be carefully fed past a rotating cleaning brush so as to completely remove the coating to fully remove the coating without damaging the symbols.

Such previous scraping utensils have not been shown in a shape or size that would serve the purpose required by the scraper. In most cases, scraping or scratching off the coating by the above devices is inconvenient. This invention describes a simple and convenient ticket scraper, specifically in a size and shape, to be used to scrape the coating off of the "scratch off" type of lottery game ticket.

SUMMARY OF THE INVENTION

Got the Itch . . . Scratch It!

The present invention relates generally to a scraper for removing the covering of instant lottery game scratch tickets, and more particularly to a hand-held scraper with the ability to precisely remove distinct rows of the covering of instant lottery game scratch tickets.

There is disclosed a scraper which is intended to replace the use of a coin, a knife or the like to remove the waxy like surface of a scratch ticket, such as a lottery scratch ticket. The scraper includes an arcuate protruding blade that has a blunt front end as a scraping blade at one end and a holding part at the other end.

The scraper has a main body with a guitar pick shape consisting of metal, plastic, and rubber construction material. The metal material, which is the thickness of a coin, is with in a plastic sleeve that has an even beveled area covered by rubber on each side of the main body for a thumb lying area and a forefinger lying area. The metal blade protrudes from the plastic sleeve at the said one end and there is a banana shaped hole for a key ring at the said other end.

The main body is formed to comfortably rest between the thumb and forefinger. The protruding blade extends out from the main body with an arched shape and a blunt end. The protruding blade is designed to allow the buyer or player to easily view the specific area of the instant lottery game ticket being scraped. As a result the non-slip grip scraper makes scratching easy and convenient.

There is also disclosed an appealing version of above said scraper (which is the basic version) within this invention. The said appealing scraper has the similar size and shape like the said basic scraper but with the lights and/or music powered by a battery in the main body.

In summary, the present invention provides a novel, handy and simple scraper, which is inexpensive and easy to manufacture. It also solves a persistent problem keeping the scraper in a convenient location where it can be easily located when the user desires to scratch off the coatings used on lottery scratch tickets.

DETAILED DESCRIPTION OF THE PREFERRED EMBODIMENTS

Figure 1:
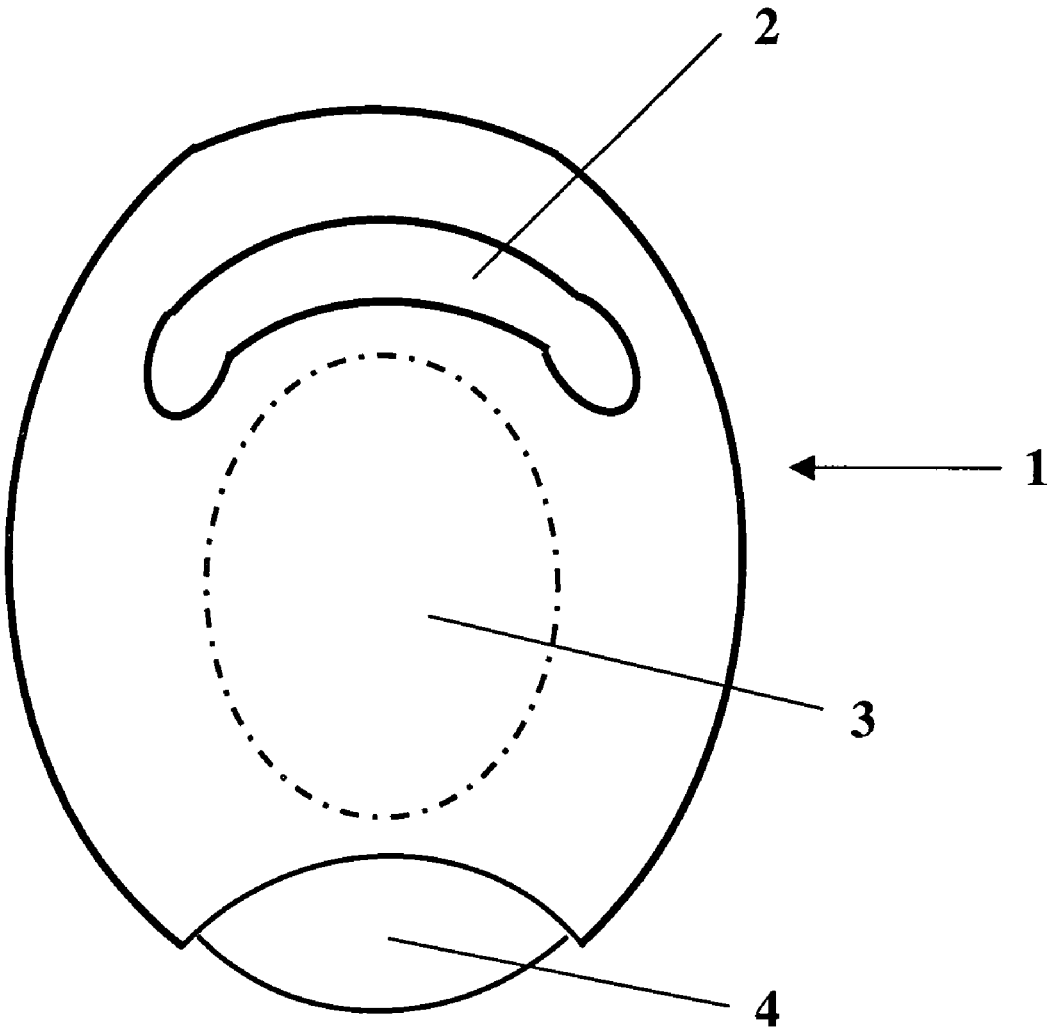
FIG. 1 presents a top plan view of the CONVENIENT TICKET SCRAPER. This is the basic version of the present invention.
Figure 2:
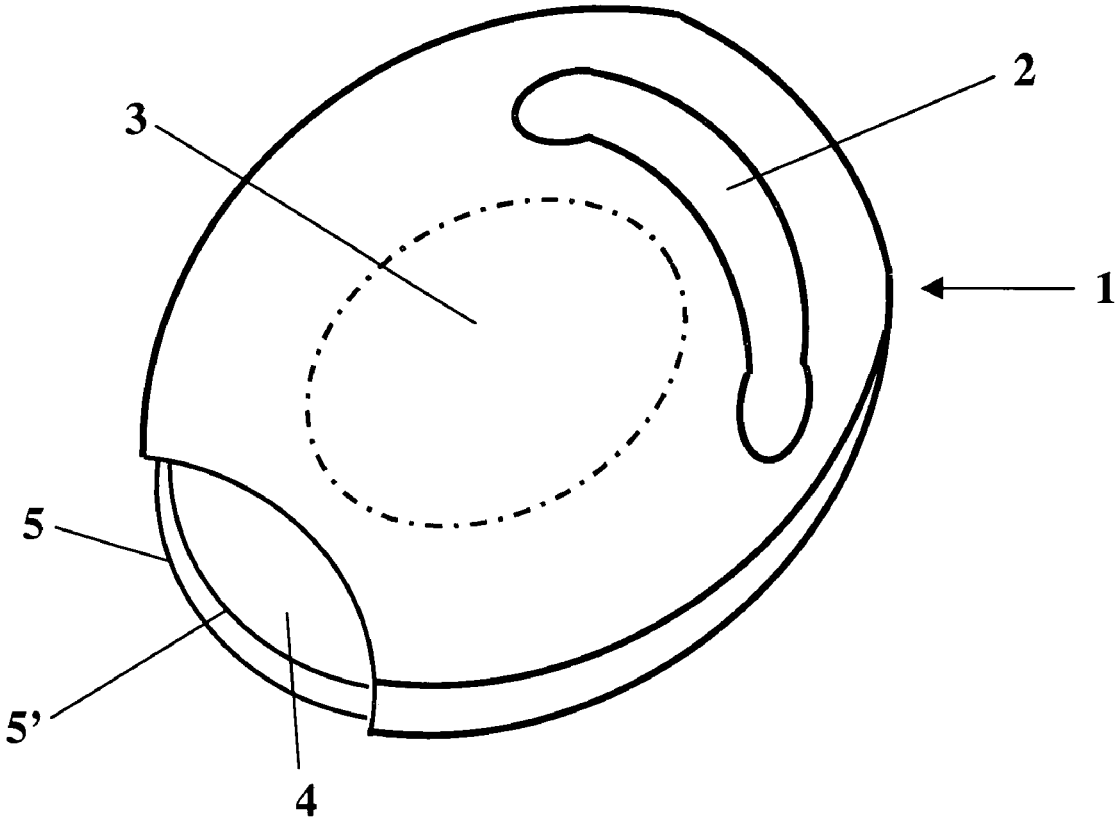
FIG. 2 presents a perspective view of the CONVENIENT TICKET SCRAPER. This is also the basic version of the present invention.

The preferred embodiments may be understood by referring to FIG. 1 and FIG. 2, which depict a top plan view of the CONVENIENT TICKET SCRAPER and a perspective view of the CONVENIENT TICKET SCRAPER.

In the drawing of FIG. 1, the said scraper, a basic version of the CONVENIENT TICKET SCRAPER, comprises main body 1, banana shaped hole 2, finger lying area 3 on both sides, and arcuate protruding blade 4. The shape of the main body 1 is guitar-pick shape, which can be produced in various decorative shapes including but not limited to teardrop shape or heart shape. Although plastic materials are preferred for the main body 1, any other material with sufficient strength like wood or stone are not excluded. A simple, cost-efficient method of manufacture would be for the main body 1, or parts thereof, to be made from an injection molded plastic. Moreover, any logo, picture, letter, lucky number or the like can be printed, taped or engraved in the main body 1. The banana shaped hole 2 is for key ring that will keep the said scraper in a convenient location such as with the key for owner's vehicle. The said banana shaped hole 2 can also be for a hook type fastener or a loop type fastener that has the hook so it can be used to attach the said scraper to any material that has loops to cooperate with the hook on the said fastener. The said banana shaped hole 2 can be other shape for key ring as long as the key ring can be moved around within the hole and will not block the fingers to hold the said scraper comfortably. The finger lying area 3 in the middle of each side of the said scraper, with oval shape, includes an even beveled area or depression to allow the user to comfortably grasp the said scraper without strain or discomfort to the user's hand. The said oval shape of finger lying area 3 is designed straight up and down between said banana shape key ring hole and said arcuate protruding blade. Moreover, the said finger lying area 3 is covered by rubber material on each side of the said scraper. The color of the main body 1 can be any color including but not limited to black, red, green, yellow, orange, blue or any bright color. The color of the finger lying area 3 can be any color including but not limited to black, red, green, yellow, orange, blue or any bright color. The color of the main body 1 is preferred different from the color of the finger lying area 3. The said above bright color will make the said scraper attractive and easy to find.

In the drawing of FIG. 2, except the above parts described in FIG. 1, the said arcuate protruding blade is made by metal, which has blunt end with two blade edges 5 and 5' that are used to scratch the surface of the "scratch off" ticket. The arcuate protruding blade, not flat edge blade, is designed to allow the buyer or player to easily view the specific area of the instant lottery game ticket being scraped. The said blunt end of the arcuate protruding blade has uniform thickness of 2-4 millimeters with two edges for scratching by either edge. The said arcuate protruding blade can be fixed in the main body 1 by any conventional way in the art.

Figure 3:
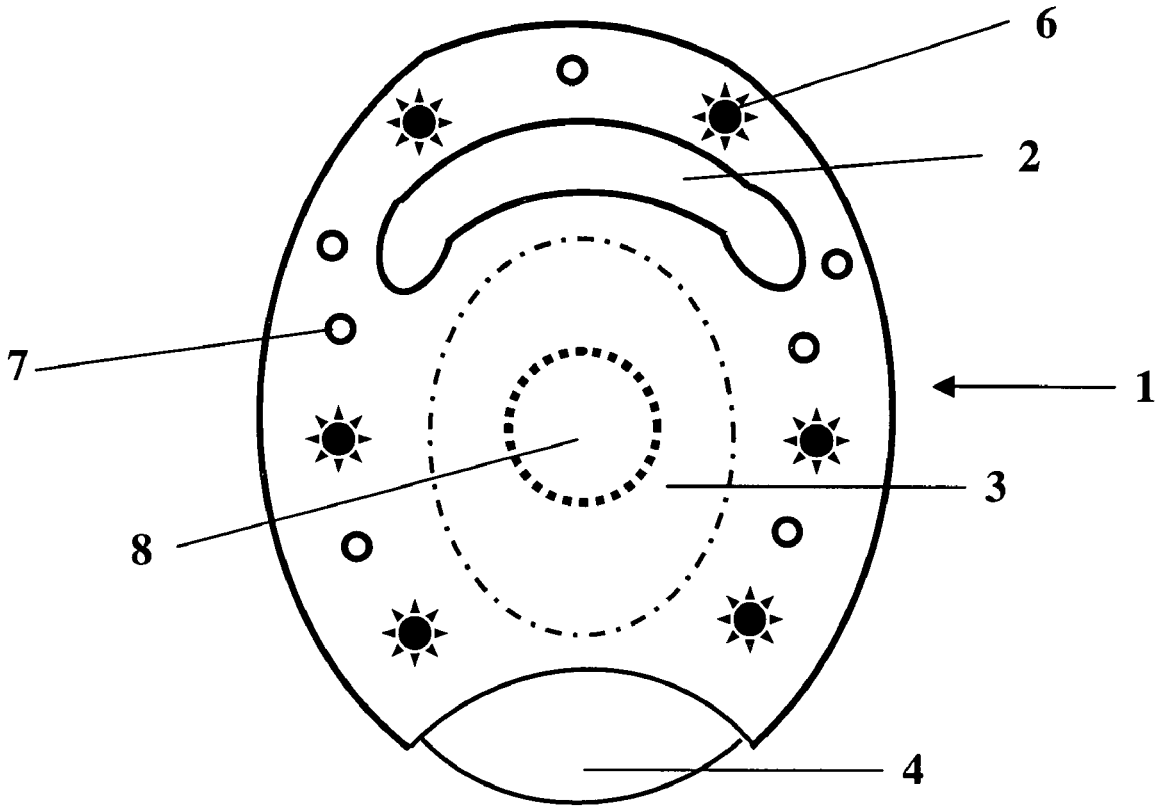
FIG. 3 presents a top plan view of the CONVENIENT TICKET SCRAPER. This is the appealing version of the present invention, with light bulbs, speaker holes, a button battery and a mini-speaker in it.

FIG. 3 shows an appealing version of the CONVENIENT TICKET SCRAPER. The light bulb 6 showed in the drawing of FIG. 3 is designed to light on when the fingers push a switch under the finger lying area 3 within the main body 1. The said light bulb 6 is located in the main body 1. The number of light bulb 6 and the location of the light bulb 6 can be varied as desired. The speaker hole 7 in the drawing of FIG. 3 is designed to allow musical sound out when the fingers push the said switch under the finger lying area 3. The said speaker hole 7 is located in the main body 1. The number of the speaker hole 7 and the location of the speaker hole 7 can be varied as desired. The battery and speaker area 8 in the drawing of FIG. 3 is designed to install a button battery and/or a mini-speaker under the finger lying area 3 within the main body 1. Also, a music-programed chip is installed in the said battery and speaker area 8. The said switch, battery, mini-speaker, and music-programmed chip are all functionally linked together. The same mechanism can be found in many musical greeting cards. When the fingers push the said switch under the finger lying area 3, the power supported by the said button battery is connected and the light bulb 6 blinks one by one around the main body 1. When the fingers push the said switch again, the power supported by the said button battery is disconnected and the light bulb 6 stops blinking. The same mechanism as above, When the fingers push the said switch under the finger lying area 3, the power supported by the said button battery is connected and music is on with the sound out of the speaker hole 7. When the fingers push the said switch again, the power supported by the said button battery is disconnected and the said music is off. This appealing version of the CONVENIENT TICKET SCRAPER can be featured with either blinking lights or music. Alternatively, when this appealing version of the CONVENIENT TICKET SCRAPER is featured with both blinking lights and music, the blinking lights and music will be simultaneously on when fingers pushed the said switch; and the blinking lights and music will be simultaneously off when fingers pushed the said switch again. Moreover, the blinking light bulbs may have the same or different colors as desired; the music may be programmed for different situations; and the color of said blinking light bulbs could be designed to coordinate with different music based on different themes.

With the appealing version of the CONVENIENT TICKET SCRAPER, users will feel excited and enjoy their scratching time. As a result of this, the ticket seller may sell more scratch tickets than usual.

In the above embodiments, a scraping device is designed with two arcuate edges sized and shaped to be utilized for scraping the coating off on the "scratch off" type lottery tickets. The advantages of the present invention are manifested in a more convenient and comfortable use in scraping various surfaces within one-piece construction as well as the bi-directional scraping capability, more particularly to a handy and appealing device for quickly and accurately processing a sequence of lottery tickets, to reveal concealed alphanumeric characters such as numbers.

Although the Convenient Ticket Scraper and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. A scraper device for scraping a coating from a ticket or the like comprises:

(a) a finger-held main body with a guitar pick shape; and (b) a banana shape key ring hole in one end of the finger-held main body; and (c) an arcuate protruding blade in the other end of the finger-held main body, wherein the finger-held main body has an oval shape finger lying area in the middle of both sides of the finger-held main body; and wherein the oval shape finger lying area is designed straight up and down between the banana shape key ring hole and the arcuate protruding blade; and wherein the oval shape finger lying area is large enough for thumb and forefinger to hold the finger-held main body, with an even beveled design; and wherein the oval shape finger lying area is covered by rubber in any color; and wherein the finger-held main body is made by plastic or other material with sufficient strength; and wherein the finger-held main body can be made in any color; and wherein the arcuate protruding blade is made by metal; and wherein the arcuate protruding blade has a uniform thickness of above or equal to 2 millimeters and less than or equal to 4 millimeters; and wherein the arcuate protruding blade has a blunt end with two edges; and (d) blinking light bulbs around the finger-held main body, not in the oval shape finger lying area, wherein the blinking light bulbs may have same or different colors as desired; and (e) a button battery under the oval shape finger lying area inside the finger-held main body, wherein the button battery provides power through a switch to the blinking light bulbs.

2. A scraper device for scraping a coating from a ticket or the like comprises:

(a) a finger-held main body with a guitar pick shape; and (b) a banana shape key ring hole in one end of the finger-held main body; and (c) an arcuate protruding blade in the other end of the finger-held main body, wherein the finger-held main body has an oval shape finger lying area in the middle of both sides of the finger-held main body; and wherein the oval shape finger lying area is designed straight up and down between the banana shape key ring hole and the arcuate protruding blade; and wherein the oval shape finger lying area is large enough for thumb and forefinger to hold the finger-held main body, with an even beveled design; and wherein the oval shape finger lying area is covered by rubber in any color; and wherein the finger-held main body is made by plastic or other material with sufficient strength; and wherein the finger-held main body can be made in any color; and wherein the arcuate protruding blade is made by metal; and wherein the arcuate protruding blade has a uniform thickness of above or equal to 2 millimeters and less than or equal to 4 millimeters; and wherein the arcuate protruding blade has a blunt end with two edges; and (d) a mini-speaker under the oval shape finger lying area inside the finger-held main body; and (e) speaker holes round the finger-held main body, not in the oval shape finger lying area; and (f) a button battery under the oval shape finger lying area inside the finger-held main body, wherein the button battery provides power through a switch to the mini-speaker; and (g) a music-programmed chip linked wit the mini-speaker and the button battery under the oval shape finger lying area inside the finger-hold main body.

3. A scraper device for scraping a coating from a ticket or the like comprises:

(a) finger-held main body with a guitar pick shape; and (b) a banana shape key ring hole in one end of the finger-held main body; and (c) an arcuate protruding blade in the other end of the finger-held main body, wherein the finger-held main body has an oval shape finger lying area in the middle of both sides of the finger-held main body; and wherein the oval shape finger lying area is designed straight up and down between the banana shape key ring hole and the arcuate protruding blade; and wherein the oval shape finger lying area is large enough for thumb and forefinger to hold the finger-held main body, with an even beveled design; and wherein the oval shape finger lying area is covered by rubber in any color; and wherein the finger-held main body is made by plastic or other material with sufficient strength; and wherein the finger-held main body can be made in any color; and wherein the arcuate protruding blade is made by metal; and wherein the arcuate protruding blade has a uniform thickness of above or equal to 2 millimeters and less than or equal to 4 millimeters; and wherein the arcuate protruding blade has a blunt end with two edges; and (d) blinking light bulbs around the finger-held main body, not in the oval shape finger lying area, wherein the blinking light bulbs may have same or different colon as desired; and (e) a mini-speaker under the oval shape finger lying area inside the finger-held main body; and (f) speaker holes around the finger-held main body, not in the oval shape finger lying area; and (g) a button battery under the oval shape finger lying area inside the finger-held main body, wherein the button battery provides power through a switch to the blinking light bulbs and the mini-speaker; and (h) a music-programmed chip linked with the mini-speaker and the button battery under the oval shape finger lying area inside the finger-held main body, and wherein the color of the blinking light bulbs may be designed to coordinate with different music based on different themes; and wherein music programmed in the music-programmed chip may be designed to coordinate with different themes.

* * * * *